US008251175B1

(12) United States Patent
Englert et al.

(10) Patent No.: US 8,251,175 B1
(45) Date of Patent: Aug. 28, 2012

(54) CORRUGATED ACOUSTICAL PANEL

(75) Inventors: Mark Englert, Libertyville, IL (US); Qing C. Yu, Libertyville, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/079,233

(22) Filed: Apr. 4, 2011

(51) Int. Cl.
*E04B 1/82* (2006.01)

(52) U.S. Cl. ..... 181/292; 181/284; 52/144; 52/145

(58) Field of Classification Search ..... 181/292, 181/284; 52/144, 145
See application file for complete search history.

(56) References Cited

U.S. PATENT DOCUMENTS

| | | | | | |
|---|---|---|---|---|---|
| 1,925,453 | A | | 9/1933 | Mazer | |
| 1,953,410 | A | * | 4/1934 | Jacobson | 181/292 |
| 2,043,988 | A | | 6/1936 | Brown | |
| 2,123,761 | A | | 7/1938 | Morton | |
| 2,308,869 | A | * | 1/1943 | Eckardt | 181/291 |
| 2,434,466 | A | | 1/1948 | Marc | |
| 2,705,523 | A | | 4/1955 | Hasselquist | |
| 2,985,553 | A | | 5/1961 | Anderson | |
| 3,293,107 | A | | 12/1966 | Wells | |
| 3,507,355 | A | * | 4/1970 | Lawson | 181/292 |
| 3,616,119 | A | | 10/1971 | Wukowitz | |
| 3,616,135 | A | | 10/1971 | Tesainer | |
| 3,684,051 | A | | 8/1972 | Hopkins | |
| 3,749,198 | A | | 7/1973 | Everitt et al. | |
| 3,757,889 | A | | 9/1973 | Everitt | |
| 3,789,953 | A | | 2/1974 | Everitt | |
| 3,804,195 | A | | 4/1974 | Everitt et al. | |
| 3,811,532 | A | | 5/1974 | Everitt | |
| 3,845,593 | A | | 11/1974 | Zen | |
| 3,848,696 | A | | 11/1974 | Everitt | |
| 3,848,697 | A | | 11/1974 | Jannot et al. | |
| 3,941,207 | A | | 3/1976 | Croup | |
| 3,963,094 | A | | 6/1976 | Nowikas | |
| 4,076,100 | A | * | 2/1978 | Davis | 181/290 |
| 4,077,821 | A | | 3/1978 | Doerfling | |
| 4,093,482 | A | * | 6/1978 | Ogata et al. | 156/210 |
| 4,114,725 | A | | 9/1978 | Croasdale | |
| 4,119,451 | A | | 10/1978 | Fujii | |
| 4,119,749 | A | | 10/1978 | Roth et al. | |
| 4,122,911 | A | | 10/1978 | Croup | |
| 4,131,702 | A | | 12/1978 | Alfter et al. | |
| 4,150,186 | A | | 4/1979 | Kazama | |
| 4,170,674 | A | * | 10/1979 | Matsuki | 428/90 |
| 4,226,299 | A | * | 10/1980 | Hansen | 181/284 |

(Continued)

FOREIGN PATENT DOCUMENTS

DE 3117137 A1 11/1982

(Continued)

*Primary Examiner* — Forrest M Phillips
(74) *Attorney, Agent, or Firm* — Pearne & Gordon LLP

(57) ABSTRACT

An acoustical panel construction useful as a suspended ceiling tile having a rectangular shape bounded by edges and establishing a face area comprising at least one corrugated layer or layers of a total thickness, the layer or layers having a multitude of parallel flutes extending across an expanse of the rectangular shape substantially from one edge of the panel to an opposite edge, the flutes being formed by walls of the layer or layers and being of known volume, a series of apertures each of known area through the wall or walls of the flutes communicating with the atmosphere at the face, the aperture area, flute cavity volume associated with an aperture, and the total thickness of the corrugated layers associated with an aperture being arranged to produce a maximum absorption frequency between 200 and 2,000 Hz.

8 Claims, 5 Drawing Sheets

U.S. PATENT DOCUMENTS 4,227,356 A 10/1980 Stern et al.
4,228,624 A 10/1980 Reneault
4,242,172 A 12/1980 Fujii
4,256,797 A 3/1981 Stamper et al.
4,309,853 A 1/1982 Lowe
4,416,716 A 11/1983 Ichikawa et al.
4,479,992 A 10/1984 Haeseker et al.
4,624,083 A 11/1986 Diffrient
4,865,201 A 9/1989 Liebel
4,886,696 A 12/1989 Bainbridge
4,933,225 A 6/1990 Abe
4,942,085 A 7/1990 Guerro
4,987,022 A 1/1991 Ueno
5,022,963 A 6/1991 Porter et al.
5,026,586 A 6/1991 Tabor
5,057,176 A * 10/1991 Bainbridge ..... 156/222
5,134,014 A 7/1992 Zaima
5,149,572 A 9/1992 Gaggero
5,206,067 A 4/1993 Bonzo
5,245,141 A 9/1993 Fortez et al.
5,290,622 A 3/1994 Tanabe
5,308,678 A 5/1994 Tsujimura et al.
5,309,690 A 5/1994 Symons
5,356,695 A 10/1994 Mori et al.
D357,108 S 4/1995 Hutchison
5,416,285 A 5/1995 Niehaus
5,433,156 A 7/1995 Hutchison
5,456,513 A 10/1995 Schmidt
5,487,344 A 1/1996 Hutchison
5,491,309 A 2/1996 Kotter
5,503,903 A 4/1996 Bainbridge et al.
5,509,247 A 4/1996 Fortez
5,568,774 A 10/1996 Hutchison
5,641,950 A 6/1997 Kotter
5,656,357 A 8/1997 Ogata et al.
5,677,032 A 10/1997 Anwyll
5,766,395 A 6/1998 Bainbridge et al.
5,879,802 A 3/1999 Beard
5,884,962 A 3/1999 Mattingly et al.
5,892,187 A 4/1999 Patrick
6,089,650 A 7/2000 Edgeller et al.
6,264,238 B1 7/2001 MacDonald et al.
6,393,129 B1 5/2002 Conrad et al.
6,575,527 B1 6/2003 Bishop, Jr.
6,578,895 B1 6/2003 Tom
6,609,591 B2 8/2003 Wisniewski
6,644,727 B2 11/2003 Audibert et al.
6,708,626 B2 * 3/2004 Ueda et al. ..... 105/452
6,789,645 B1 9/2004 Deblander
6,868,940 B1 3/2005 Mekwinski
6,951,264 B2 10/2005 Byma et al.
6,966,402 B2 11/2005 Matias et al.
7,128,365 B2 10/2006 Kiesewetter
7,128,366 B2 10/2006 Russell
7,194,846 B2 3/2007 Swiszcz et al.
2001/0005964 A1 7/2001 Colson et al.
2001/0029718 A1 10/2001 Snyder et al.
2003/0019179 A1 * 1/2003 Colson et al. ..... 52/506.06
2003/0192278 A1 10/2003 Snyder et al.
2004/0123555 A1 7/2004 Cole
2010/0175335 A1 * 7/2010 Fuller et al. ..... 52/145

FOREIGN PATENT DOCUMENTS

JP 58-177742 A 10/1983

* cited by examiner

FIG. 1
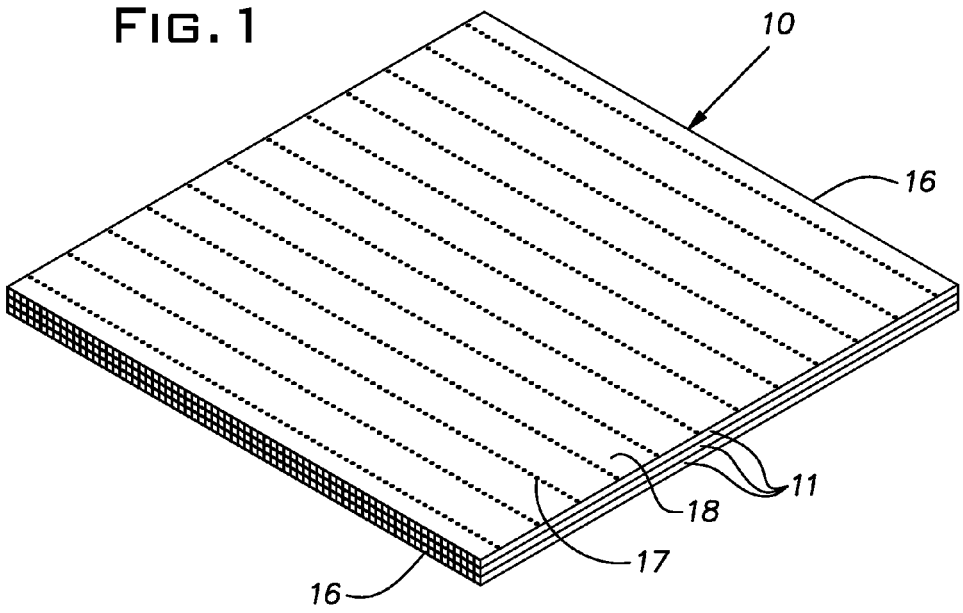
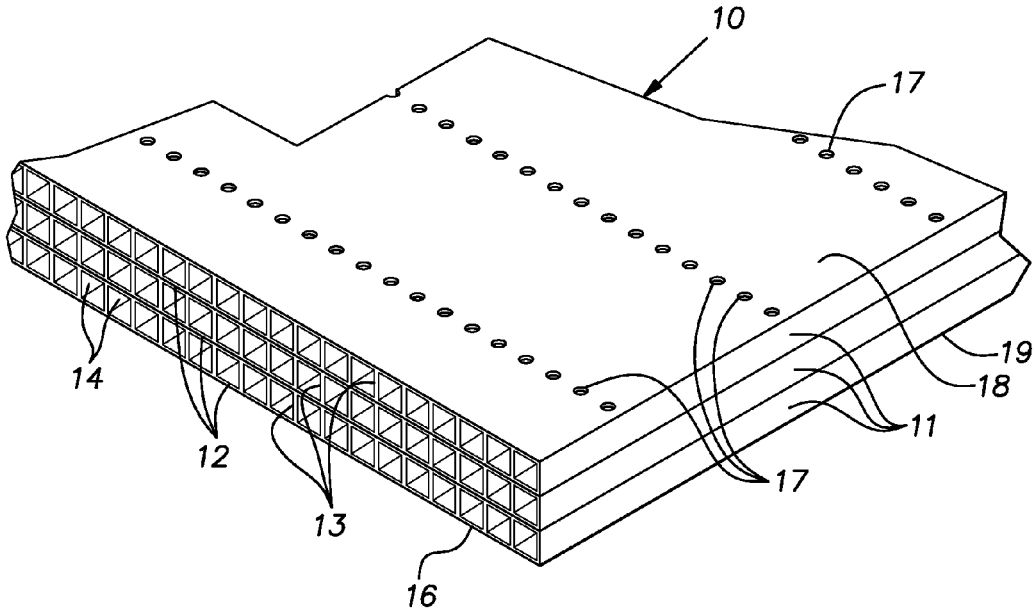
FIG. 1A

CORRUGATED ACOUSTICAL PANEL

BACKGROUND OF THE INVENTION

The invention relates to acoustical panels particularly suited for use in suspended ceilings.

PRIOR ART

Acoustical panels typically used as ceiling tiles or on walls, serve to absorb unwanted noise as well as to enclose a space and/or serve an architectural function.

Most conventional ceiling panels are made from a water-felting process or a water-based cast process. Usually a panel has a homogeneous porous core capable of absorbing sound. Lower cost products of these types are susceptible to sagging over time as a result of moisture absorption and have limited noise absorption capabilities measured as noise reduction coefficient (NRC). Higher grade products are typically more expensive to produce and can be relatively heavy. For the most part, water felted and water cast products exhibit relatively low sound absorption efficiency below 800 Hz. and are especially ineffective below 400 Hz.

SUMMARY OF THE INVENTION

The invention provides an acoustical panel formed of an apertured corrugated layer or layers with highly desirable sound absorbing properties. The panel is arranged to absorb those sound frequencies audible to the human ear and can be readily tuned to absorb sound in the lower frequencies of normal human hearing range. The invention is applicable to corrugated panels made of, for example, cardboard or plastic, either of which can be of a high recycled content.

The invention is based on the realization that corrugated panels perforated in a particular manner behave as pseudo Helmholtz resonating cavities able to produce relatively high NRC values and capable of being tuned to absorb a maximum of sound energy at a relatively low targeted frequency or frequencies.

More specifically, the invention relies on the discovery that the individual flutes of a corrugated panel can be treated like Helmholtz resonating cavities. By adjusting the relative size of the flutes, apertures, and aperture spacings, the frequency of maximum absorption can be determined. This frequency can be selected to target a specific noise or frequency band. Studies have shown corrugated panels can achieve ENRC (estimated noise reduction coefficient) as high as 0.8 with an absorption coefficient of 0.98 at a maximum absorption frequency below 600 Hz., for example. Moreover, these studies have shown a high correlation between classic Helmholtz cavity parameters and the analogous parameters discovered in the apertured corrugated acoustical panels of the invention.

BRIEF DESCRIPTION OF THE DRAWINGS

FIG. 1 is an isometric view of a first embodiment of an acoustical panel constructed in accordance with the invention;

FIG. 1A is a fragmentary view of the panel of FIG. 1 on an enlarged scale;

DESCRIPTION OF THE PREFERRED EMBODIMENTS

Figure 2:
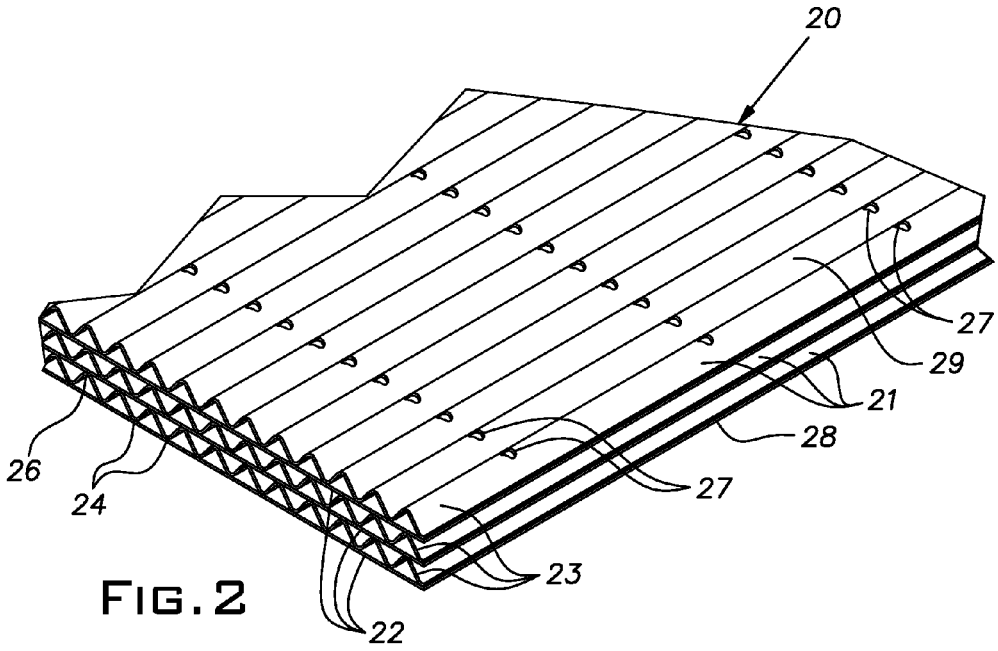
FIG. 2 is a fragmentary isometric view of a second embodiment of the invention.

In the various embodiments disclosed below, the invention is applied to ceiling panels for use, ordinarily, with suspended ceiling grid. In the industry, such panels have nominal face dimension of 2'×2' or 2'×4' or metric equivalents.

FIG. 1 shows an acoustical tile or panel 10 formed of three layers of extruded corrugated plastic sheet. In this construction, each layer 11 has a pair of main walls 12 between which are webs 13 parallel with one another and perpendicular to the main walls 12. Adjacent pairs of webs 13 and areas of the main walls 12 form flutes or elongated cavities 14 that extend from one edge 16 of a panel to an opposite edge 16. The main walls 12 of abutting layers 11 are suitably bonded together with an adhesive, by welding or other technique. The layers 11 can be extruded polyethylene copolymer; a suitable source for the layers 11 is Coroplast™, Dallas, Tex. USA. Apertures 17 are drilled, punched, or otherwise formed in a face 18 of the panel 10 formed by an outer wall 12 of one of the layers 11 and all of the other walls 12 of the layers 11 except the layer at a rear face 19 of the panel opposite the face 18. Thus, in the illustrated arrangement of FIGS. 1 and 1A, each hole on the face 18 overlies a series of coaxial holes or apertures in the inner walls 12 of the sandwiched layers 11. The panel of FIG. 1 and other panels described below and illustrated in the drawings are inverted from a normal installed orientation when they are used in a suspended ceiling where the apertured face 18 will be facing downwardly towards the interior of a room. In practicing the invention, at least one and ordinarily more than one set of coaxial apertures is formed in each flute 14.

It has been discovered that an apertured or perforated corrugated panel such as shown in FIG. 1, and on a larger scale FIG. 1A, forms a series of pseudo Helmholtz resonating cavities. The classical Helmholtz formula for a cavity with a necked opening is:

$$j_H = \frac{v}{2\pi}\sqrt{\frac{A}{V_o L}}$$

where:

$f_H$ is the resonance frequency;

v is the speed of sound;

A is the cross-sectional area of the neck;

$V_o$ is the volume of the cavity; and

L is the length of the neck.

For the embodiment of FIG. 1 and other embodiments including those discussed below, extensive research has demonstrated that certain dimensional parameters of the corrugation flutes and apertures are analogous to the dimensional parameters of the classic Helmholtz formula. These analogous parameters are:

area of aperture $A_o$ correlates to A, the neck area;

internal volume $V_f$ of a flute between adjacent apertures or holes (essentially a measure of two half flute volumes on each side of an aperture) correlates to $V_o$;

the distance T from the apertured face to the opposed blind wall, taken as the thickness of the panel, correlates to L.

A maximum absorption frequency of a panel can be determined in accordance with the invention using these correlated parameters in the classic Helmholtz equation.

Sound frequency audible to the human ear and that is of concern, for example, in the NRC rating ranges between 200 Hz and 2,000 Hz. While traditional water-felted or cast ceiling tiles absorb sound at the higher ranges of these frequencies, they are of very limited effectiveness at or below 400 or 500 Hz. Moreover, it is difficult to economically produce a traditional tile with an NRC value greater than 0.7. It has been found that apertured corrugated panels such as disclosed in FIG. 1, can be readily tuned for maximum absorption at selected frequencies between 200 and 2,000 Hz. Such panels can be especially useful, as compared to conventional tile construction, in targeting noise at 800 Hz. or less. By way of example, ENRC test samples using an impedance tube according to ASTM 384 on three-layer 10 mm Coroplast™ had the following results.

3-Layer Data—10 mm Coroplast™

| Number of Layers | Hole Diameter | Segment Length | Number of Holes | Max Abs Freq (Hz) | Absorption Coefficient | ENRC |
|---|---|---|---|---|---|---|
| 3 | 0.075 | 2.00 | 16 | 436 | 0.694 | 0.643 |
| 3 | 0.101 | 2.00 | 16 | 526 | 0.870 | 0.716 |
| 3 | 0.128 | 2.00 | 16 | 596 | 0.982 | 0.809 |
| 3 | 0.157 | 2.00 | 16 | 676 | 0.999 | 0.588 |
| 3 | 0.199 | 2.00 | 16 | 792 | 0.982 | 0.546 |

The foregoing table shows the effect of aperture size on the maximum absorption frequency. The smaller the aperture or perforation, the lower the absorption frequency.

Maximum absorption frequency is affected by the spacing between apertures measured in the lengthwise direction of the flutes. The greater the spacing the greater the resonant cavity volume, and consistent with the analogy to Helmholtz's equation, the lower the frequency.

It can be demonstrated that as the panel is made thicker and therefore the effective parameter T analogous to the Helmholtz neck opening length L is increased, the maximum absorption frequency will decrease.

FIG. 2 represents a panel 20 as a second embodiment of the invention utilizing conventional cardboard that includes a corrugated paper sheet. Similar to the panel 10, the panel 20 comprises several corrugated layers 21 with each layer comprising a flat paper sheet 22 and a curvilinear corrugated paper sheet 23 bonded to the flat sheet at contact lines 24 between flutes 26. Apertures 27 are drilled, punched or otherwise formed through the corrugated and flat sheets of the layers 21 except the sheet 22 at a panel face 28 opposite a face 29 from which the apertures are formed. The apertures 27 through the several sheets 22, 23 are of the same size and are coaxial along an axis perpendicular to the faces 28, 29.

The analogous parameters of the panel corresponding to the Helmholtz cavity resonant frequency equation are essentially the same as those given above in connection with the Coroplast™ 10. These analogous parameters are:

$A_o$=the area of an aperture;

Vf=the volume of a flute taken as the cross-sectional area of a flute times the distance between apertures;

T=taken as the total thickness of the panel.

It is possible to form apertures through the various layers 21, except for the last sheet, centered between the flutes 26 so as to utilize the spaces between the flutes as additional resonant cavities.

Figure 3:
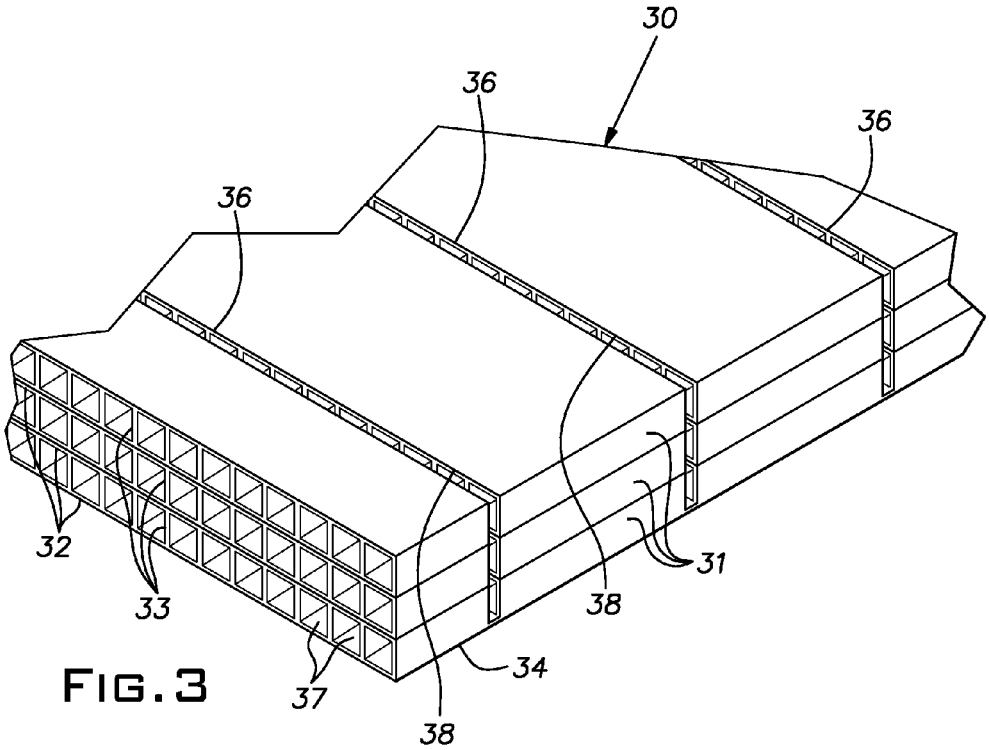
FIG. 3 is a fragmentary isometric view of a third embodiment of the invention.

A third embodiment of an acoustic panel 30, represented in FIG. 3, is similar to that of FIG. 1 in that it comprises three extruded double wall corrugated layers 31. All of the main walls, designated 32 and web walls designated 33, except for the main wall on a rear face 34 of the panel 30 are cut with vertical slots or slits 36, extending perpendicularly to the lengthwise direction of flutes 37 of the corrugated layers 31. The slots 36 create individual apertures 38 for each of the flutes 37. The analogous parameters of the panel 30 shown in FIG. 3 are as follows:

$A_o$=Aperture area is the slot width times the flute width, i.e. the distance between adjacent flutes;

Vf=the volume of a flute between slots 36; or half the flute volume on each side of a slot;

T=the thickness of the panel 30.

Note that the flute volume relationship holds true for each of the disclosed embodiments. It is contemplated that the flutes could be blocked midway between the apertures extending along a flute such as by crushing or collapsing the walls locally and the same acoustic results would be obtained.

Figure 4:
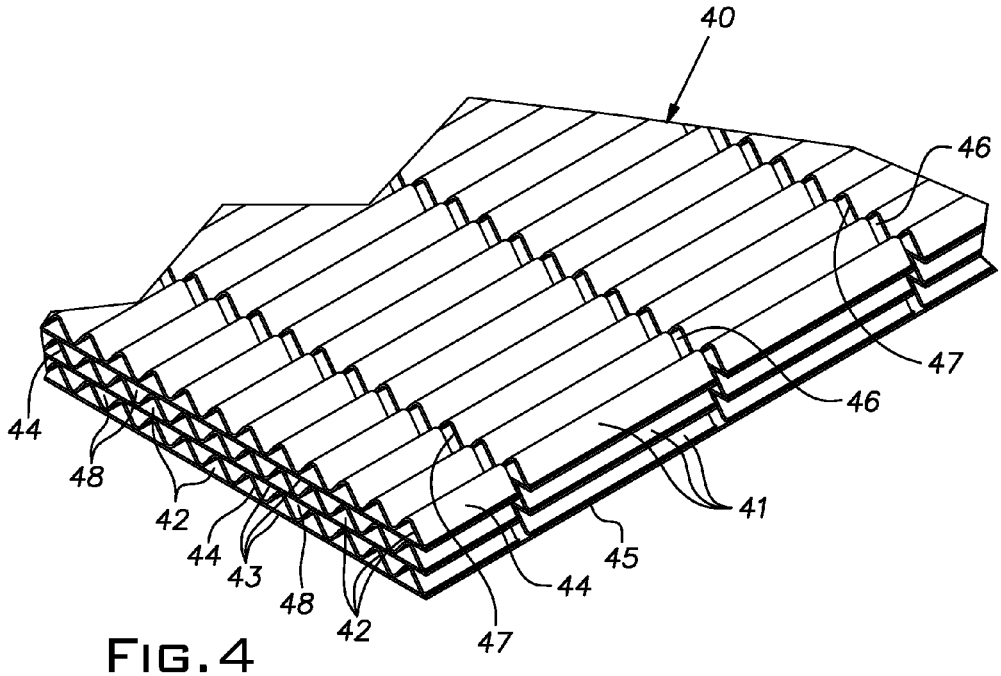
FIG. 4 is a fragmentary isometric view of a fourth embodiment of the invention.

FIG. 4 illustrates an acoustical panel similar to the panel of FIG. 3. The panel 40 is constructed of corrugated cardboard like the panel of the embodiment of FIG. 2. Three corrugated cardboard, single wall layers are shown. The corrugations form flutes 42. Flat walls 43 and corrugated sheets 44, except for a flat wall on a rear face 45 of the panel 40 are cut through with vertical slots 46 perpendicular to the lengthwise direction of the flutes 42. Where the slots 46 cross the flutes 42, apertures 47 are formed.

The analogous parameters of the panel 40 are as follows:

$A_o$=the width of the slot 46 times the distance between flutes;

Vf=the volume of a flute 42 between adjacent slots 46;

T=the thickness of a panel 40.

Spaces 48 intervening the flutes 42, being of substantially the same volume as the flutes, will absorb sound at substantially the same maximum absorption frequency as that of the flutes.

The panels illustrated in FIGS. 1-4 are exemplary of applications of the invention. In these embodiments, three corrugated layers have been shown, but it will be understood that as few as one and as many of four layers have been found to be practical.

Figure 5:
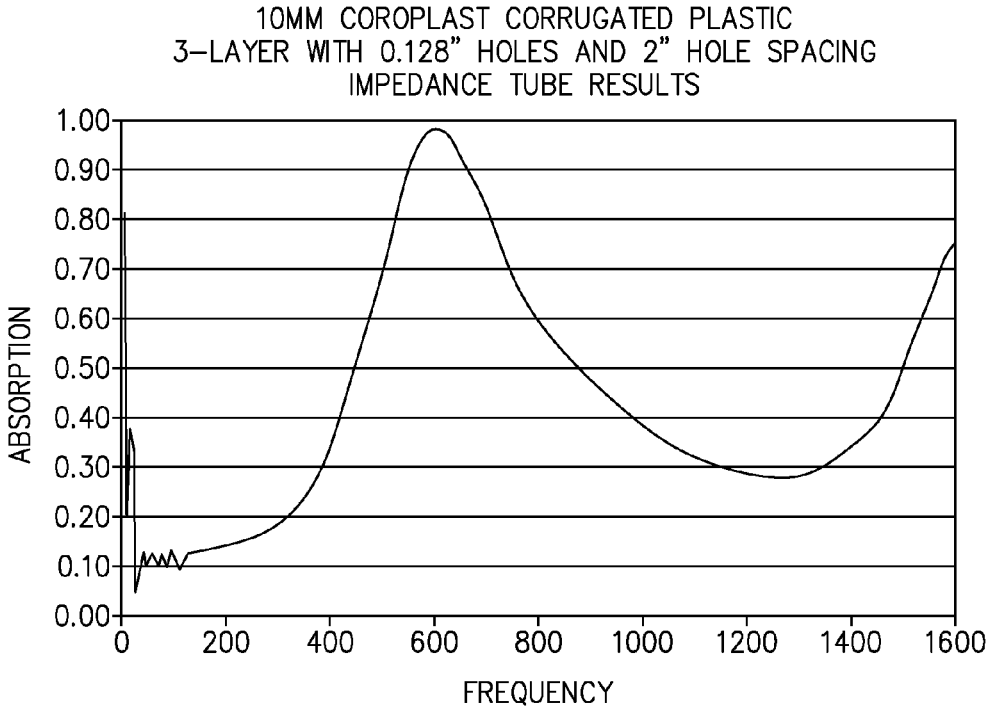
FIGS. 5 and 6 are graphs of the acoustical absorption properties of examples of panels constructed in accordance with the invention.
Figure 6:
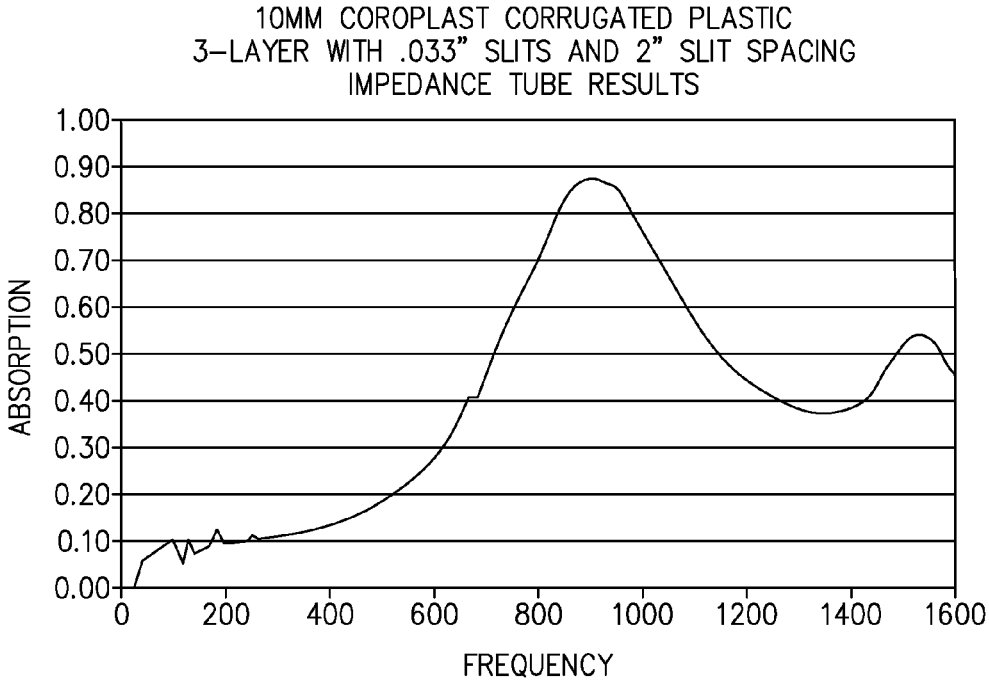

FIGS. 5 and 6 are graphs of the sound absorption characteristics of apertured corrugated acoustic panels constructed in accordance with the invention. It will be seen that the frequency of sound at maximum absorption is about 600 Hz in FIG. 5 and about 900 Hz in FIG. 6. By adjusting the parameters of a panel, the maximum absorption frequency can be reduced or increased as desired.

Figure 7:
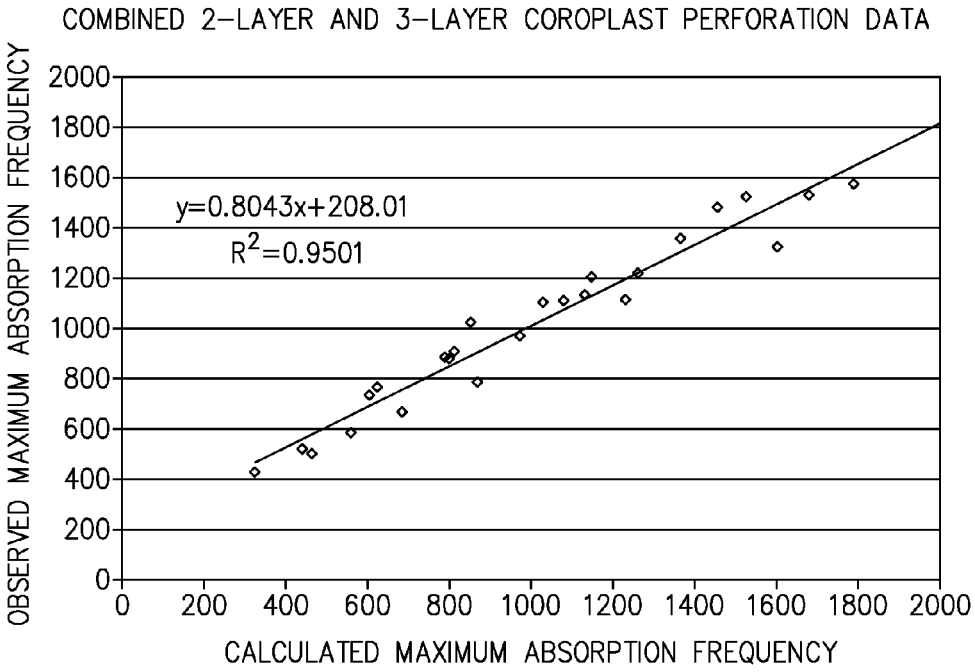
FIGS. 7 and 8 are graphs showing the linear correlation between calculated and observed absorption frequency of panels with apertures formed, respectively, by round holes or slits.
Figure 8:
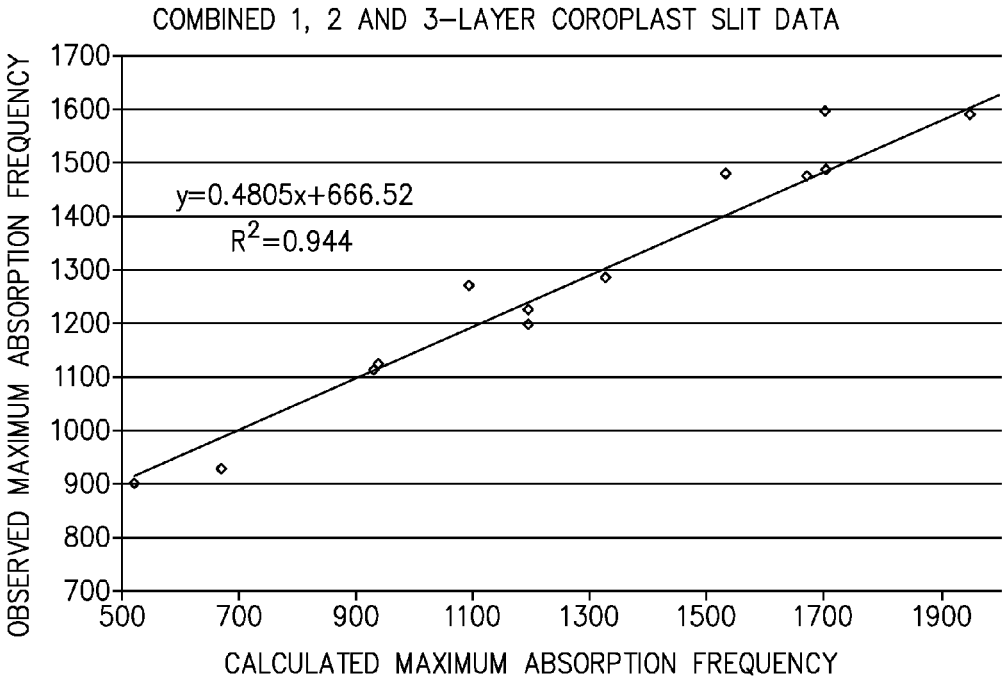

As indicated, the flute cavities can be treated as pseudo Helmholtz resonating cavities that produce maximum sound absorption at the resonant frequency. Extensive studies have shown a high linear correlation between a calculated resonant frequency of maximum absorption using the analogous parameters discussed above. Examples of the correlation between calculated and observed frequency are shown in FIGS. 7 and 8.

If certain parameters are initially determined such as panel thickness, flute cross-sectional area, and distance along the flutes between apertures, two or more samples can be made with a different aperture size. A resonant or maximum absorption frequency can be calculated and be determined by empirical results for the samples. If an ideal actual resonance frequency is not obtained, with these samples, simple extrapolation of these data points can be used to modify the values of the analogous parameters to quickly reach a proper value of a selected variable or variables to obtain a desired maximum absorption frequency. By selecting the proper values of the analogous parameters, essentially any sound frequency between, say 200 and 2,000 Hz. can be established as a maximum absorption frequency. The invention, when practiced as described, is especially useful to produce a panel with a maximum absorption frequency at a value between 200 and 800 Hz. Sound absorption in this audible range is not readily obtained by traditional wet felted or cast ceiling tile.

Figure 9:
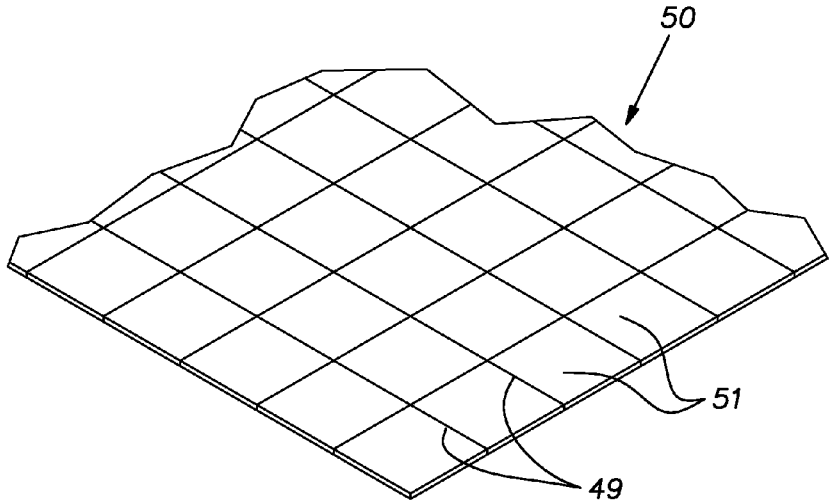
FIG. 9 is a schematic illustration of a suspended ceiling system employing the acoustical panels of the invention.

FIG. 9 schematically illustrates a suspended ceiling of generally conventional construction, including metal runners or tees 49 forming a rectangular grid and acoustic panels 51 of the corrugated construction described above. Different panels 51 tuned to absorb different frequencies of, for example, 250, 500, 1,000 and 2,000 Hz. to thereby obtain a broad sound absorption range. Alternatively, a single panel can have a plurality of distinct areas that each provides different maximum absorption frequency. In either of the latter examples, a ceiling system can be designed to absorb sound through a broad human audible range. The apertured faces of the panels can be covered with an acoustically transparent scrim or veil to visually conceal the apertures. The hollow nature of the various disclosed panel embodiments permits them to exhibit the characteristics of a sandwich panel including a high stiffness in proportion to mass. Relatively high sag resistance is achievable, for example, by treating the paper forming the corrugations with humidity-resistant material.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An acoustical panel useful as a suspended ceiling tile having a rectangular shape bounded by edges and establishing a face area comprising at least one corrugated layer or layers of a total thickness, the layer or layers having a multitude of parallel flutes extending across an expanse of the rectangular shape substantially from one edge of the panel to an opposite edge, the flutes being formed by walls of the layer or layers and being of known volume, a series of apertures each of known area through the wall or walls of the flutes communicating with the atmosphere at the face, the aperture area, flute cavity volume associated with an aperture, and the total thickness of the corrugated layers associated with an aperture being arranged to produce a maximum absorption frequency between 200 and 2,000 Hz.

2. An acoustical panel as set forth in claim 1, wherein the corrugated layers are of a type that have a curvilinear cross-section characteristic of cardboard.

3. An acoustical panel as set forth in claim 1, wherein the corrugations are rectangular in cross-section.

4. An acoustical panel as set forth in claim 1, wherein the apertures are round, coaxial holes in the face and interior walls parallel or near parallel to said face.

5. An acoustical panel as set forth in claim 1, wherein the apertures are cross-sectional openings in the layer or layers formed by slotting the same perpendicularly to said flutes.

6. An acoustical panel as set forth in claim 1, wherein the apertures are disposed along the flutes and the volume of a flute cavity is the product of the cross-sectional area of a flute and the length of the flute devoted to the respective aperture.

7. A method of making an acoustical panel by providing a rigid rectangular sheet having at least one layer of corrugations, the corrugated layer or layers having a plurality of flutes with interior hollow cavities and extending parallel to one another between a pair of edges of the sheet, the sheet having a front face on one side and a rear face on a side opposite the front face, the front face being formed with apertures communicating with the flute cavities, a total thickness of the corrugated layer or layers, the area of an aperture, and the effective volume of a flute cavity associated with an aperture being selected to permit the cavities to operate as pseudo Helmholtz cavities with a maximum sound absorbing frequency of between 200 and 2,000 Hz.

8. A method as set forth in claim 7, wherein a plurality of samples are made on a preliminary basis using a pseudo Helmholtz formula, empirically testing the samples, and making further refinement by extrapolating the empirical results, to more finely adjust the aperture area, thickness of the panel, and flute cavity volume relationship to more closely obtain a desired maximum absorption frequency.

* * * * *

UNITED STATES PATENT AND TRADEMARK OFFICE

CERTIFICATE OF CORRECTION

PATENT NO. : 8,251,175 B1
APPLICATION NO. : 13/079233
DATED : August 28, 2012
INVENTOR(S) : Mark Englert et al.

It is certified that error appears in the above-identified patent and that said Letters Patent is hereby corrected as shown below:

Column 2, line 50, in the Helmholtz formula, "$j_H$" should be --$f_H$--.

Signed and Sealed this
Twentieth Day of November, 2012

David J. Kappos

David J. Kappos
*Director of the United States Patent and Trademark Office*